US011083341B2

(12) United States Patent
Belback

(10) Patent No.: US 11,083,341 B2
(45) Date of Patent: Aug. 10, 2021

(54) BATHING LEG RESTRAINT

(71) Applicant: Deborah Belback, Marietta, GA (US)

(72) Inventor: Deborah Belback, Marietta, GA (US)

( * ) Notice: Subject to any disclaimer, the term of this patent is extended or adjusted under 35 U.S.C. 154(b) by 82 days.

(21) Appl. No.: 16/718,905

(22) Filed: Dec. 18, 2019

(65) Prior Publication Data

US 2020/0187722 A1 Jun. 18, 2020

Related U.S. Application Data

(60) Provisional application No. 62/781,243, filed on Dec. 18, 2018.

(51) Int. Cl.
*A47K 3/00* (2006.01)

(52) U.S. Cl.
CPC ..... *A47K 3/001* (2013.01)

(58) Field of Classification Search
CPC ..... A47K 3/001; A47K 3/125; A47K 3/07; A47K 3/12; A61G 7/109; A61G 7/0755; A61G 7/1061; A61G 7/1096
USPC ..... 4/560.1, 573.1, 575.1
See application file for complete search history.

(56) References Cited

U.S. PATENT DOCUMENTS

| | | | | |
|---|---|---|---|---|
| 3,855,644 | A * | 12/1974 | Benson | A47K 3/127 4/575.1 |
| 5,535,458 | A | 7/1996 | Siverly | |
| 6,804,842 | B1 | 10/2004 | Johnson | |
| 8,122,529 | B2 | 2/2012 | Steggert | |
| 8,898,826 | B2 | 12/2014 | Kobzan | |
| 2003/0163866 | A1 | 9/2003 | Northington et al. | |

* cited by examiner

*Primary Examiner* — Lauren A Crane
(74) *Attorney, Agent, or Firm* — Boudwin Intellectual Property; Daniel Boudwin

(57) ABSTRACT

A bathing leg restraint includes a pair of base members and a connector member connecting the base members. A support extends upwardly from an upper surface of each base member. A leg restraint member is affixed to an upper end of each support, such that each leg restraint member is rotatably secured to its respective support. The lower surface of each base member is securable to the inner surface of a bathing enclosure, such as a bathtub. The base members contact and support the inner thighs of the user when the user is seated upright within the bathtub. The leg restraint members can be rotated overtop of the user's legs to prevent their legs from rising out of the water. The base members and the leg restraint members maintain the user's legs in a submerged state and prevent the user from sliding downwardly toward the opposite end of the bathtub.

20 Claims, 3 Drawing Sheets

BATHING LEG RESTRAINT

CROSS REFERENCE TO RELATED APPLICATIONS

This application claims the benefit of U.S. Provisional Patent Application No. 62/781,243, filed on Dec. 18, 2018. The above identified patent application, as well as U.S. Design Pat. Application No. 29/691,479, filed on May 16, 2019, are herein incorporated by reference in their entirety to provide continuity of disclosure.

BACKGROUND OF THE INVENTION

The present invention relates to bathing comfort and safety accessories. More particularly, the present invention provides a bathing leg restraint that can be utilized to keep the user's legs submerged when bathing in a bathtub or similar bathing enclosure, in order to maintain contact with the base of the bathtub to prevent the user from sliding out of a desired position while bathing.

Many individuals choose to bathe in an upright seated position, which is typically accomplished by sitting in one end of a bathtub filled with water. When a bathtub, hot tub, jacuzzi, or similar bathing enclosure is filled with water, parts of the body tend to float upward due to the buoyant force of the water. Particularly, an individual's legs will tend to rise up out of the water as the remainder of their mass contacts the inner surface of the tub. This causes the skin of the legs to be exposed, which may be uncomfortable while bathing.

Additionally, as their legs rise upwardly out of the water, the force exerted by the individual's mass on the surface of the bathtub is reduced. If such force is reduced below a threshold amount, it negates the effect of static friction between the individual and the surface of the bathtub. This will cause the individual to slide downward toward the base of the bathtub, moving from an upright seated position to a horizontal supine position. Sliding toward the end of the bathtub may also occur if an individual falls asleep while bathing in the bathtub and is unable to adjust themselves to keep themselves upright. For such individuals, or for any individual with limited mobility, it may be difficult to stop themselves from sliding downward, and it may be even more difficult to prop themselves up and return to a sitting position. A dangerous situation can arise where the individual slides so far down toward the foot end of the bathtub that their head becomes submerged. If the individual is unable to return themselves to the upright seated position, continuous submersion of their head can lead to asphyxiation or drowning. In order to address these concerns, it is desirable to provide a bathing leg restraint device that can be utilized to keep the legs submerged and comfortably maintain an individual in an upright, seated position while bathing.

Devices have been disclosed in the known art that related to comfort accessories for bathing. However, these devices have several drawbacks. As an example, some of these devices provide cushions or pillows that can be secured to the interior surface of the bathtub in an attempt to provide a comfortable support surface while bathing, which may help to stop the user from sliding downwards toward the foot of the bathtub. However, the main purpose of these devices is to provide a cushioned support surface for comfort rather than to prevent unwanted movement of the user. Further, these devices do not include a mechanism for retaining the legs in a submerged state. These devices also tend to be bulky and reduce the effective area in which the user may occupy the bathtub.

In light of the devices disclosed in the known art, it is submitted that the present invention substantially diverges in design elements from the known art, and consequently it is clear that there is a need in the art for an improvement to existing bathing and bathtub comfort and safety accessories. In this regard, the present invention substantially fulfills these needs.

SUMMARY OF THE INVENTION

In view of the foregoing disadvantages inherent in the known types of bathing comfort and safety accessories now present in the prior art, the present invention provides a bathing leg restraint wherein the same can be utilized for providing convenience for the user when bathing, in order to comfortably maintain their body in an upright seated position.

In an exemplary embodiment, the bathing leg restraint includes a pair of base members, a connector member connecting the base members, a support extending upwardly from an upper surface of each base member, and a leg restraint member affixed to an upper end of each support, wherein each leg restraint member is rotatably secured to its respective support.

One object of the present invention is to provide a bathing leg restraint that maintains the user in a comfortable, upright seated position while in a bathtub or similar bathing enclosure.

Another object of the present invention is to provide a bathing leg restraint that maintains the user's legs in a submerged state while in a bathtub or similar bathing enclosure.

A further object of the present invention is to provide a bathing leg restraint that includes fasteners for effectively securing the bathing leg restraint to the inner surface of the bathtub or other bathing enclosure.

Yet another object of the present invention is to provide a bathing leg restraint that includes rotatably adjustable leg restraint members, such that the leg restraint members can be rotated overtop the user's legs during use and rotated away from the user's legs prior to or after use.

Still a further object of the present invention is to provide a bathing leg restraint that includes height adjustable supports for the leg restraining members, in order to adjust the bathing leg restraint for comfortable use for different sizes of bathing enclosures or different sizes of users.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
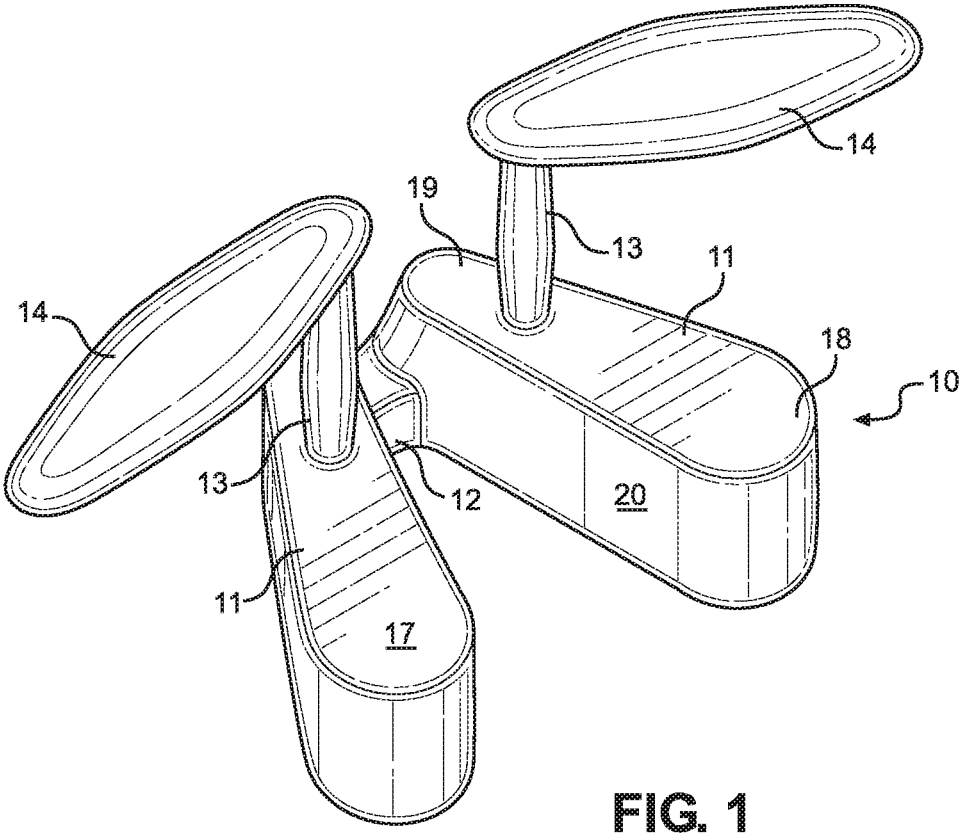
FIG. 1 shows a top perspective view of an embodiment of the bathing leg restraint.

Reference is made herein to the attached drawings. Like reference numerals are used throughout the drawings to depict like or similar elements of the bathing leg restraint. For the purposes of presenting a brief and clear description of the present invention, the preferred embodiment will be discussed as used for maintaining an individual's body in an upright seated position with their legs submerged while bathing. Reference is made to the present invention being utilized within a "bathtub", but it is to be understood that the present invention can be utilized in any similar bathing enclosure such as a hot tub, jacuzzi, or the like which can accommodate an individual in an upright seated position. The figures are intended for representative purposes only and should not be considered to be limiting in any respect.

Referring now to FIG. 1, there is shown a top perspective view of an embodiment of the bathing leg restraint. The bathing leg restraint 10 includes a pair of base members 11 that are connected via a connecting member 12. In the illustrated embodiment, each base member 11 extends angularly outwardly from one end of the connector member 12. In this way, a V shaped opening is defined between the interior surfaces 20 of the base members 11. This allows the base members 11 to flex under pressure from the user's legs, as demonstrated in FIG. 5, in order to provide a comfortable support surface upon which the user's legs may rest in their natural position. Further, in the shown embodiment, each base member includes a varying width that tapers inwardly from a front end 18 of the base member 11 to a rear end 19 of the base member 11, such that a width of the front end 18 of each base member 11 is greater than a width of the rear end 19 of each base member 11. This configuration can provide additional cushioning to the area of the user's legs located toward the knees, which typically includes less tissue mass between the skin and the bone, and may require a larger, softer supporting section for adequate comfort.

In the shown embodiment, the connecting member 12 is continuous with the rear end 19 of each base member 11. However, other embodiments may include base members 11 that are removably or adjustably secured to the connecting member 12, such that the device can be collapsed to a compact position for storage when not in use, or disassembled for cleaning if needed. The base members 11 and the connector member 12 can be composed of a comfortable foam material or any other suitable materials that are water resistant and provide comfort to the user.

A support 13 is connected to the upper surface of each base member 11. The supports 13 extend upwardly from each base member 11 in a generally vertical orientation. A leg restraint member 14 is affixed to the upper end of each support 13. In the shown embodiment, the leg restraint members 14 are rotatably connected to the supports 13. This allows each leg restraint member 14 to be rotated overtop the user's leg during use, and rotated away from the user's leg when not in use, such that the user can easily enter or exit the bathtub while the bathing leg restraint 10 is secured therein.

Figure 2:
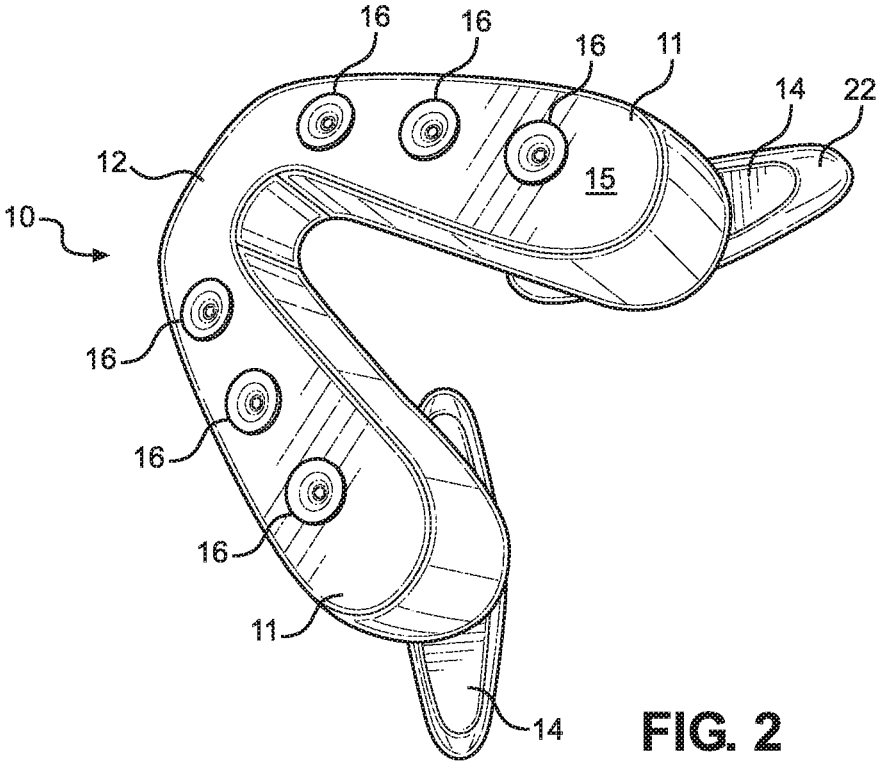
FIG. 2 shows a bottom perspective view of an embodiment of the bathing leg restraint.

Referring now to FIG. 2, there is shown a bottom perspective view of an embodiment of the bathing leg restraint. In some embodiments, the lower surface 15 of the bathing leg restraint 10 includes a plurality of fasteners 16. In the shown embodiment, the fasteners 16 include suction cups that can easily and effectively secure the bathing leg restraint 10 to the inner surface of a bathtub. In some embodiments, additional fasteners may be disposed on a lower surface of the connector member 12 for providing additional securing forces. In embodiments with no fasteners, the lower surfaces 15 of the base members 11 can include a high friction material in order to prevent the bathing leg restraint 10 from moving within the bathtub. Further, in the shown embodiment, the leg restraint members 14 both include a distal end 22 that extends outwardly over the exterior sides of the base members 11, such that the leg restraint members 14 can be positioned overtop the user's legs.

Figure 3:
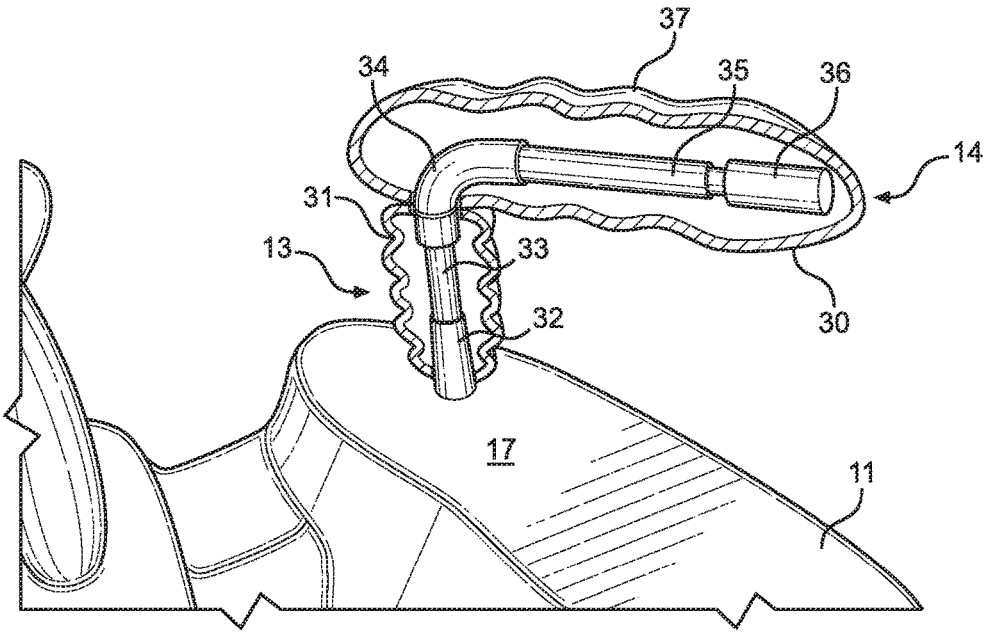
FIG. 3 shows a cross-sectional view of an embodiment of the bathing leg restraint showing the leg restraint member in a retracted position.
Figure 4:
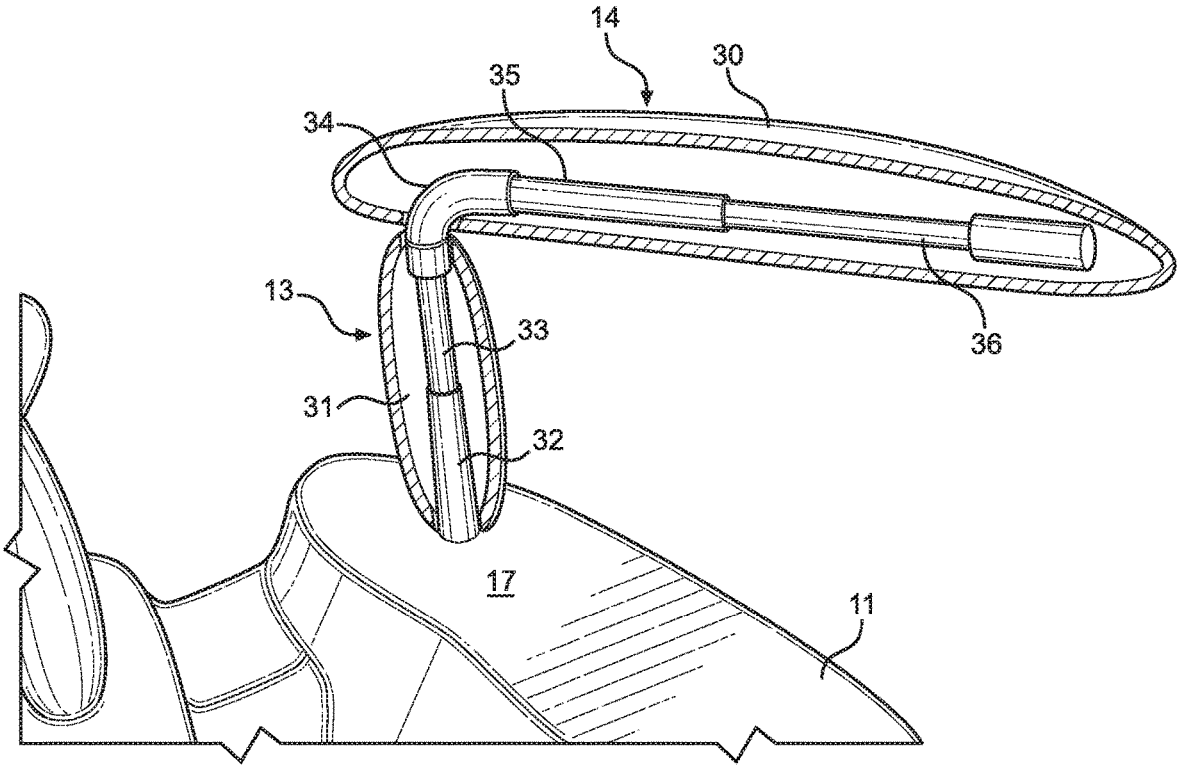
FIG. 4 shows a cross-sectional view of an embodiment of the bathing leg restraint showing the leg restraint member in an extended position.

Referring now to FIGS. 3 and 4, there is shown a cross sectional view of an embodiment of the bathing leg restraint showing the leg restraint member in a retracted position and a cross sectional view of an embodiment of the bathing leg restraint showing the leg restraint member in an extended position, respectively. In some embodiments, the supports 13 are adjustable in height, such that the device can be adjusted for use for individuals of different sizes, or for use in bathtubs of different depths. In the illustrated embodiment, the supports 13 include a base portion 32 affixed to the upper surface 17 of the base member 11 and a telescoping portion 33 slidably inserted into the base portion 32, such that the supports 13 are telescopically adjustable in height. Similarly, the leg restraint members 14 include a base portion 35 and a telescoping portion 36 slidably inserted into the base portion 35, such that the leg restraint members 14 are adjustable in length. In the shown embodiment, the telescoping portion 33 of the support 13 is connected to a lower vertical end of an elbow connector 34, and the base portion 35 of the of the leg restraint member 14 is connected to an upper horizontal end of the elbow connector 34. In this way, the height of the support 13 and the length of the leg restraining member 14 are independently adjustable, such that maximum effectiveness and comfort may be easily achieved when the device is in use. The elbow connectors 34 may further be utilized to facilitate rotation of the leg restraint members 14, such that the leg restraint members 14 rotate independently of their supports 13. In other embodiments, the supports 13 and the leg restraint members 14 have a rigid connection, such that each may rotate together with respect to the base members 11.

As illustrated, the supports 13 may include flexible covers 31 that deform as the height of each support 13 is adjusted. The leg restraint members 14 may also include flexible covers 30 that deform to expand or contract along with the leg restraint members 14 as their length is adjusted. The leg restraint member covers 30 and the support covers 31 provide a comfortable support surface while helping to prevent the adjustable components of the supports 13 and the leg restraint members 14 from potentially being damaged by prolonged exposure to moisture. The covers 30, 31 may further include ridges 37 that form as the covers 30, 31 contract to their respective retracted positions.

Figure 5:
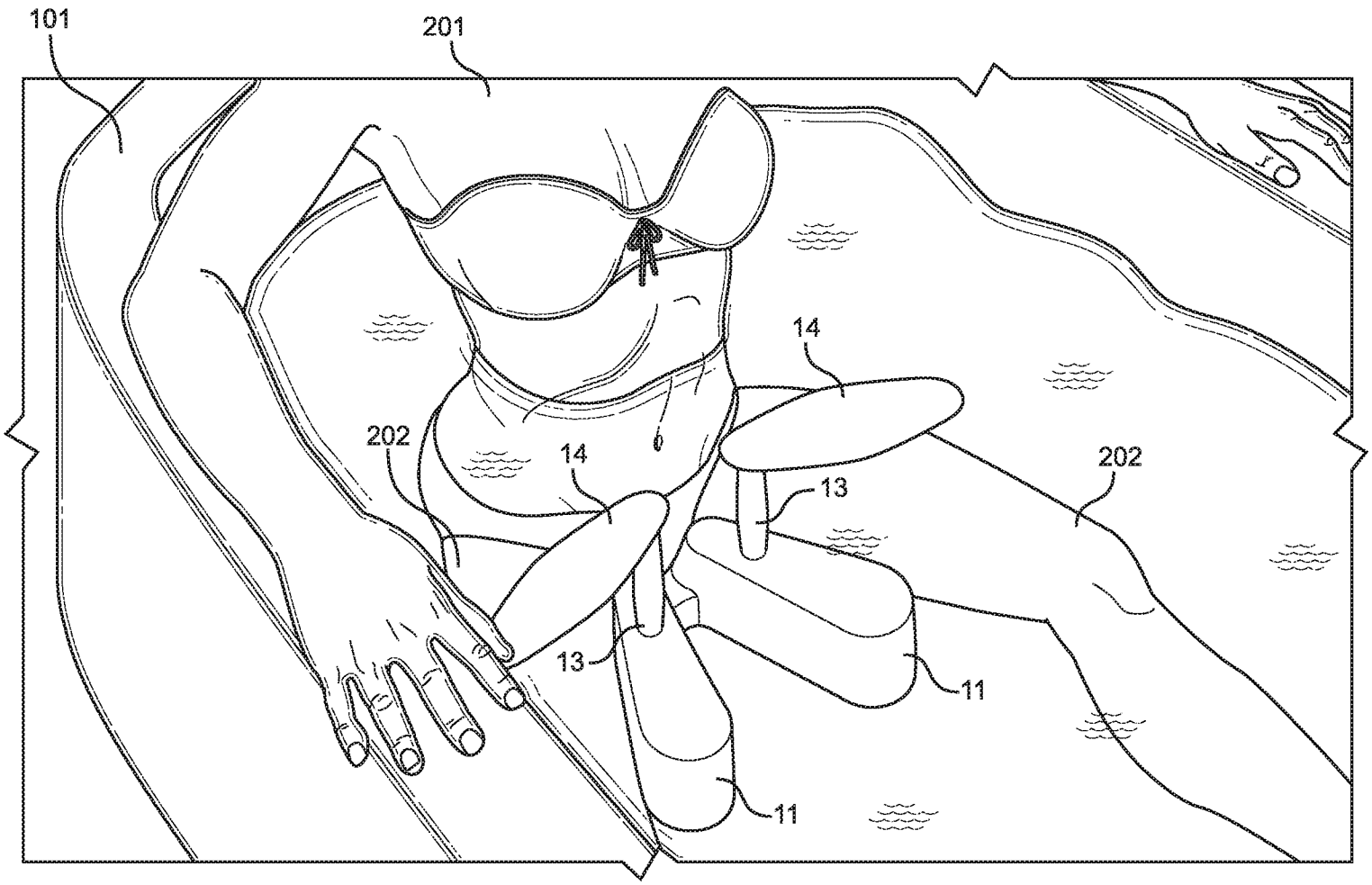
FIG. 5 shows a perspective view of an embodiment of the bathing leg restraint in use.

Referring now to FIG. 5, there is shown a perspective view of an embodiment of the bathing leg restraint in use. In operation, the device can be secured to the lower interior surface of a bathtub. The user 201 may then sit down within the bathtub, such that the inner side of their legs 202 are supported by the outer sides of the base members 11. The base members 11 extend angularly outwardly from opposing ends of the connector member 12, which allows the base members 11 to flex to a comfortable position under pressure of the user's legs 202. Since the base members 11 are secured to the bathtub, the user 201 is supported in an upright position and is prevent from sliding downwardly toward the opposite end of the bathtub from an upright seated position to a supine laying position.

After properly positioning themselves within the bathtub in an upright seated position, the user 201 may rotate the leg restraint members 14 overtop of their legs 202, in order to retain their legs 202 in a submerged state. As their legs 202 are prevented from floating upwardly in the water, the user's 201 desired seated position is maintained. In the shown embodiment, each leg restraint member 14 includes a middle section have a width that is greater than a width of a pair of opposing end sections. This increases the surface area of the portion of the leg restraint member 14 that contacts the user's leg 202, which provides increased comfort for the user. Overall, the present invention provides a bathing leg restraint that comfortably supports a user in an upright position while bathing, preventing them from accidentally sliding toward the opposite end of the bathtub to a laying position, It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathing leg restraint, comprising:

a pair of base members;

a connector member connecting the base members;

a support extending upwardly from an upper surface of each base member;

a leg restraint member affixed to an upper end of each support;

wherein each leg restraint member is rotatably secured to its respective support.

2. The bathing leg restraint of claim 1, further comprising a plurality of fasteners disposed on a lower side of each base member.

3. The bathing leg restraint of claim 2, wherein the plurality of fasteners comprises suction cups.

4. The bathing leg restraint of claim 1, wherein each base member extends angularly outwardly from one end of the connector member.

5. The bathing restraint of claim 1, wherein the connector member is continuous with a rear end of each base member.

6. The bathing leg restraint of claim 1, wherein each base member includes a varying width that tapers inwardly from a front end to a rear end thereof, such that a width of the front end of each base member is greater than a width of the rear end of each base member.

7. The bathing leg restraint of claim 1, wherein each leg restraint member includes a flexible cover secured thereto.

8. The bathing leg restraint of claim 1, wherein each support includes a flexible cover secured thereto.

9. A bathing leg restraint, comprising:

a pair of base members;

a connector member connecting the base members;

a support extending upwardly from an upper surface of each base member;

a leg restraint member affixed to an upper end of each support;

wherein each leg restraint member is rotatably secured to its respective support;

wherein each support is configured to be adjustable in height.

10. The bathing leg restraint of claim 9, further comprising a plurality of fasteners disposed on a lower side of each base member.

11. The bathing leg restraint of claim 10, wherein the plurality of fasteners comprises suction cups.

12. The bathing leg restraint of claim 9, wherein each base member extends angularly outwardly from one end of the connector member.

13. The bathing restraint of claim 9, wherein the connector member is continuous with a rear end of each base member.

14. The bathing leg restraint of claim 9, wherein each base member includes a varying width that tapers inwardly from a front end to a rear end thereof, such that a width of the front end of each base member is greater than a width of the rear end of each base member.

15. The bathing leg restraint of claim 9, wherein each leg restraint member includes a flexible cover secured thereto.

16. The bathing leg restraint of claim 9, wherein each support includes a flexible cover secured thereto.

17. The bathing leg restraint of claim 9, wherein each support is connected to one of the leg restraint members via an elbow joint.

18. The bathing leg restraint of claim 9, wherein each support comprises a telescopic configuration, such that each support is movable between a retracted position and an extended position.

19. The bathing leg restraint of claim 9, wherein each leg restraint member comprises a telescopic configuration, such that each leg restraint member is movable between a retracted position and an extended position.

20. The bathing leg restraint of claim 9, wherein each leg restraint member comprises a middle section have a width that is greater than a width of a pair of opposing end sections.

* * * * *